US005687571A

United States Patent [19]

Althaus et al.

[11] Patent Number: 5,687,571

[45] Date of Patent: Nov. 18, 1997

[54] COMBUSTION CHAMBER WITH TWO-STAGE COMBUSTION

[75] Inventors: Rolf Althaus, Kobe, Japan; Jakob J. Keller, Dottikon, Switzerland

[73] Assignee: Asea Brown Boveri AG, Baden, Switzerland

[21] Appl. No.: 596,770

[22] Filed: Feb. 5, 1996

[30] Foreign Application Priority Data

Feb. 20, 1995 [CH] Switzerland ..... 487/95

[51] Int. Cl.[6] ..... F23R 3/30; F23R 3/34

[52] U.S. Cl. ..... 60/737; 60/746

[58] Field of Search ..... 60/737, 738, 746, 60/747, 39.826

[56] References Cited

U.S. PATENT DOCUMENTS 4,192,139 3/1980 Buchheim ..... 60/39.826
4,910,957 3/1990 Moreno et al. ..... 60/746
4,928,481 5/1990 Joshi et al. ..... 60/737

FOREIGN PATENT DOCUMENTS 0321809 6/1989 European Pat. Off. .
0576697A1 1/1994 European Pat. Off. .

*Primary Examiner*—Louis J. Casaregola
*Attorney, Agent, or Firm*—Burns, Doane, Swecker & Mathis, L.L.P.

[57] ABSTRACT

A combustion chamber with two-stage combustion has primary burners (110) of the premixing type of construction, in which the fuel injected via nozzles (117) is intensively mixed with the combustion air inside a premixing space (130) prior to ignition. The primary burners are of flame-stabilizing design, i.e. they are designed without a mechanical flame retention baffle. They are provided with tangential inflow of the combustion air into the premixing space (130). Arranged downstream of a precombustion chamber (61) are secondary burners (150) which are designed as premixing burners which do not operate by themselves.

7 Claims, 2 Drawing Sheets

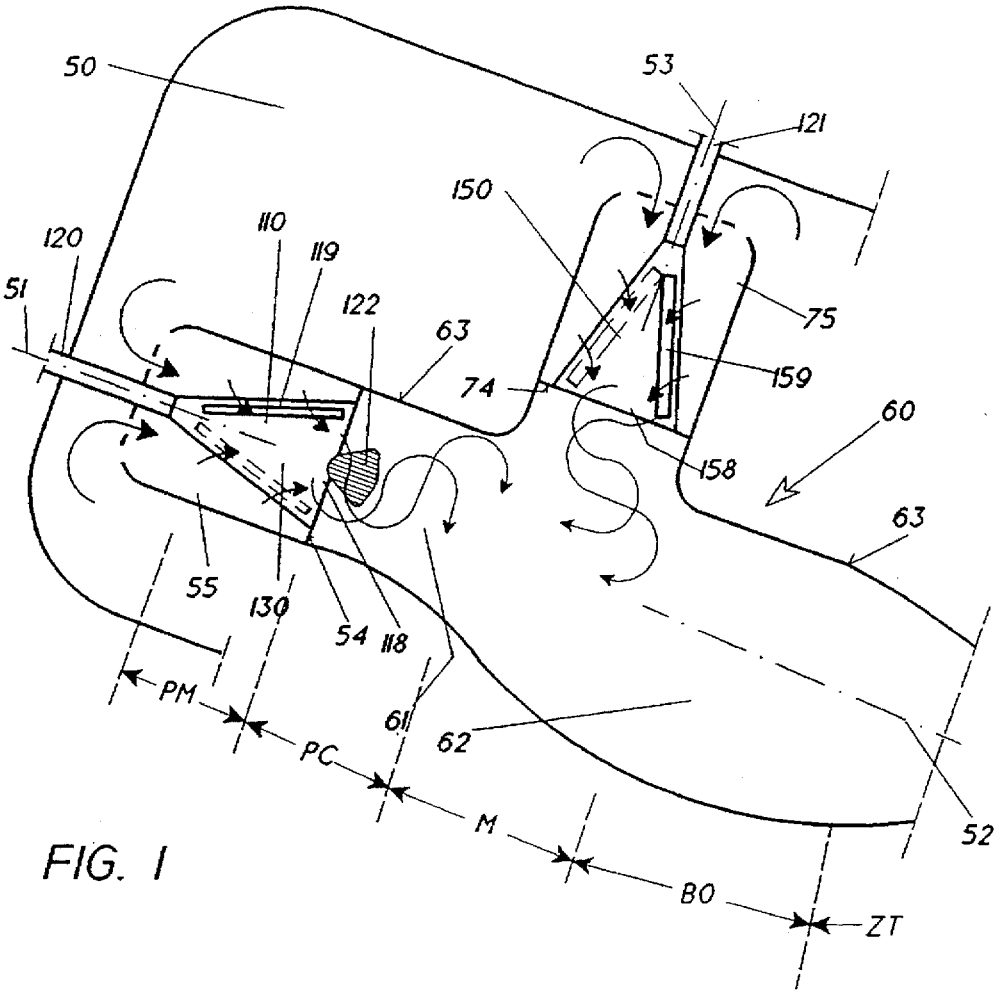
FIG. 1
FIG. 5
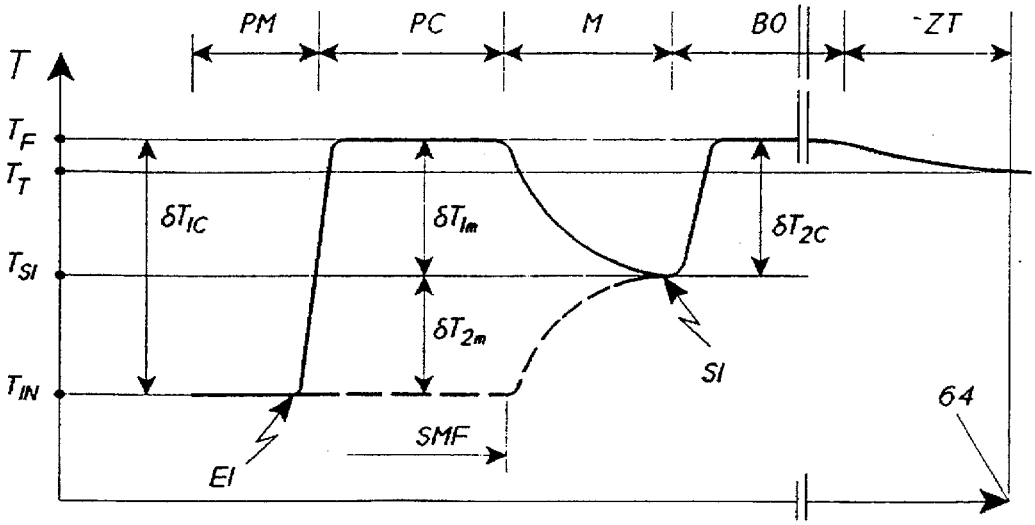

COMBUSTION CHAMBER WITH TWO-STAGE COMBUSTION

FIELD OF THE INVENTION

The invention relates to a combustion chamber with two-stage combustion, having at least one primary burner of the premixing type of construction, in which the fuel injected via nozzles is intensively mixed with the combustion air inside a premixing space prior to ignition, and having at least one secondary burner which is arranged downstream of a precombustion chamber.

BACKGROUND

The combustion having the highest possible excess-air coefficient, on the one hand owing to the fact that the flame is actually still burning and furthermore owing to the fact that not too much CO develops, not only reduces the NOx pollutant quantity but in addition also keeps other pollutants at a low level, namely CO and uncombusted hydrocarbons. This enables a higher excess-air coefficient to be selected, in which case larger quantities of CO certainly develop to begin with but these quantities of CO can react further to form CO2 so that finally the CO emissions remain low. On the other hand, however, only a little additional NO forms on account of the large amount of excess air. Since a larger number of burners are as a rule arranged in a combustion chamber for gas turbines for example, in each case only so many elements are operated with fuel during the load control that the optimum excess-air coefficient is obtained for the respective operating phase (start, part load, full load).

In order to achieve reliable ignition of the mixture in the downstream combustion chamber and satisfactory burn-out, intimate mixing of the fuel with the air is necessary. Good intermixing also helps to avoid so-called hot spots in the combustion chamber, which lead, inter alia, to the formation of unwanted NOx. For this reason, two-stage combustion chambers having premixing burners of the type mentioned at the beginning in the primary stage are being increasingly used.

This is because the single-stage combustion chambers having premixing burners are inadequate in the sense that the limit of flame stability is nearly reached at least in the operating states in which only some of the burners are operated with fuel or during which a reduced fuel quantity is admitted to the individual burners. Indeed, under typical gas-turbine conditions, the extinction limit will already be reached at an excess-air coefficient of about 2.0 on account of the very lean mixture and the resulting low flame temperature.

This fact leads to a relatively complicated mode of operation of the combustion chamber with correspondingly complicated control. Assisting the burner by means of a small diffusion flame is seen as another possibility of extending the operating range of premixing burners. This pilot flame receives pure fuel or at least poorly premixed fuel, which on the one hand certainly leads to a stable flame but on the other hand results in the high NOx emissions typical of diffusion combustion.

SUMMARY OF THE INVENTION

Accordingly, one object of the invention, in attempting to avoid all these disadvantages, is to provide low-emission secondary combustion.

This object is achieved according to the invention in that the primary burner is a flame-stabilizing premixing burner without a mechanical flame retention baffle, having an at least approximately tangential inflow of the combustion air into the premixing space, and in that the secondary burner is a premixing burner which does not operate by itself.

Such flame-retaining premixing burners may, for example, be the burners of the so-called double-cone type of construction, as disclosed by U.S. Pat. No. 4,932,861 to Keller et al. and described later with reference to FIGS. 1 to 3B. The fuel, gas in this case, is injected in the tangentially running inlet gaps via a row of injector nozzles into the flow of combustion air coming from the compressor. As a rule, the injector nozzles are uniformly distributed over the entire gap.

The advantage of the invention may be seen in particular in secondary combustion which is neutral in terms of NOx.

Owing to the fact that the burners remain operable on a very lean mixture,. the control can also be simplified in as much as, during loading and relief of the combustion chamber, air-coefficient ranges which as a rule could not be covered by the previous premixing combustion can be crossed without extinction of the flame having to be avoided by separate means.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 1 shows a partial longitudinal section of a combustion chamber;

FIG. 5 shows a diagram of temperature along the extent of the combustion chamber.

Figure 2:
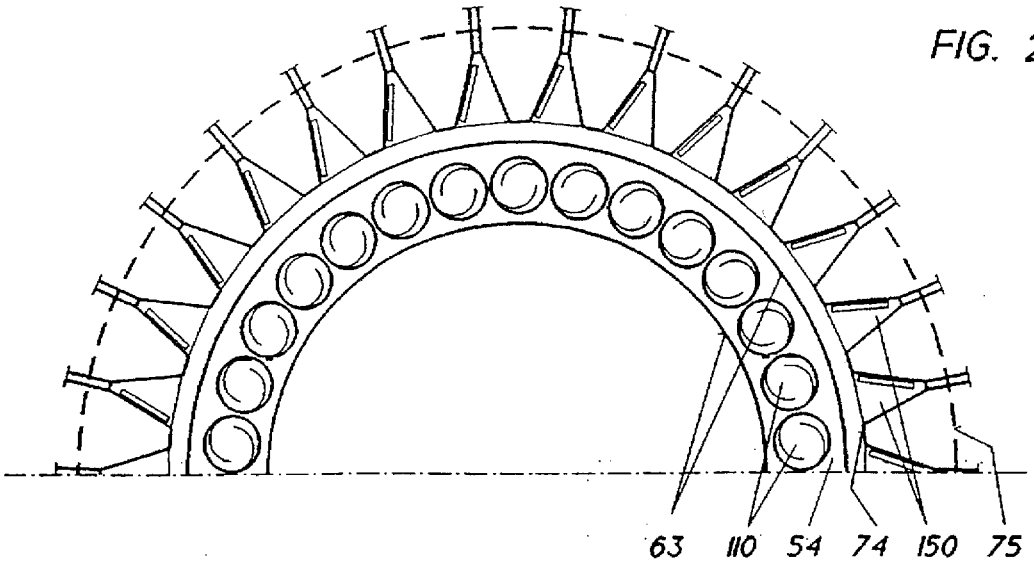
FIG. 2 shows a partial cross-section through the combustion chamber.
Figure 3A:
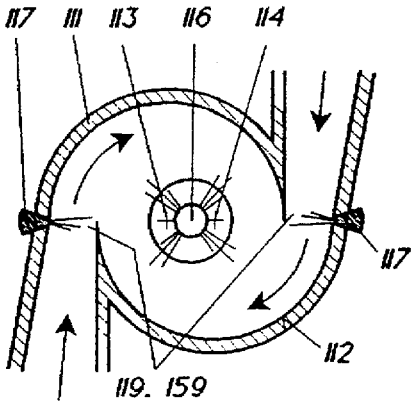
FIG. 3A shows a cross-section through a premixing burner of the double-cone type of construction in the region of its outlet.
Figure 3B:
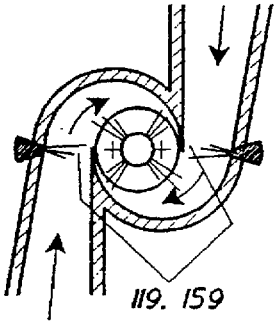
FIG. 3B shows a cross-section through the same premixing burner in the region of the cone tip.

Only the elements essential for understanding the invention are shown. Not shown, for example, is the complete combustion chamber and its allocation to a plant, the provision of the fuel, the control equipment and the like. The direction of flow of the working media is designated by arrows.

DESCRIPTION OF THE PREFERRED EMBODIMENTS

Referring now to the drawings, wherein like reference numerals designate identical or corresponding parts throughout the several views, in FIG. 1 an encased plenum is designated by 50, which as a rule receives the combustion air delivered by a compressor (not shown) and feeds it to an annular combustion chamber 60. This combustion chamber is of two-stage design and essentially comprises a precombustion chamber 61 and a main combustion chamber 62 situated downstream, both of which are encased by a combustion chamber wall 63.

An annular dome 55 is mounted on the precombustion chamber 61, which is located at the head end of the combustion chamber 60 and the combustion space of which is defined by a front plate 54. A burner 110 is arranged in this dome in such a way that the burner outlet is at least approximately flush with the front plate 54. The longitudinal axis 51 of the primary burner 110 runs coaxially to the longitudinal axis 52 of the combustion chamber 60. A plurality of such burners 110 are arranged next to one another, distributed over the periphery on the annular front plate 54 (FIG. 2). Via the dome wall perforated at its outer end, the combustion air flows out of the plenum 50 into the dome interior and is admitted to the burners. The fuel is fed to the burner via a fuel lance 120 which passes through the dome and plenum wall.

A number of secondary burners 150 are arranged in the plane in which the precombustion chamber 61 merges into the main combustion chamber 62. The secondary burners 150 are likewise premixing burners. Their longitudinal axis 53 runs perpendicularly to the longitudinal axis of the primary burner 110.

These secondary burners also sit on a front plate 74 and are surrounded by an annular dome 75. The burner 150 is arranged in this dome in such a way that the burner outlet 158 is at least approximately flush with the front plate 74. A plurality of such burners 150 are arranged next to one another, distributed over the periphery on the annular front plate 74 (FIG. 2). Via the dome wall perforated at its outer end, the combustion air flows out of the plenum 50 into the dome interior and is admitted to the burners. The fuel is fed to the burner via a fuel lance 121 which passes through the dome and the plenum wall.

The distance between the secondary burners and the outlet plane 118 of the primary burners is equal to about one burner diameter. The outlet plane 158 of the secondary burner is set back from the combustion chamber wall 64.

In the case shown in FIG. 2, the same number of primary burners 110 and secondary burners 150 (here about 30 of each) are arranged over the periphery, their axes being offset from one another by half a pitch in the peripheral direction. However, this number and arrangement is not compulsory.

Each of the premixing burners 110 and 150 schematically shown in FIGS. 1, 2, 3A and 3B is a so-called double-cone burner as already mentioned above and as disclosed, for example, by U.S. Pat. No. 4,932,861 to Keller et al. It essentially comprises two hollow, conical sectional bodies 111, 112 which are nested one inside the other in the direction of flow. In this arrangement, the respective center axes 113, 114 of the two sectional bodies are mutually offset. The adjacent walls of the two sectional bodies form slots 119, tangential in their longitudinal extent, for the combustion air, which in this way passes into the burner interior. Arranged there is a first fuel nozzle 116 for liquid fuel. The fuel is injected into the hollow cone at an acute angle. The resulting conical fuel profile is enclosed by the combustion air flowing in tangentially. The concentration of the fuel is continuously reduced in the axial direction as a result of the mixing with the combustion air. In the example, the burner is likewise operated with gaseous fuel. To this end, gas-inflow openings 117 distributed in the longitudinal direction in the walls of the two sectional bodies are provided in the region of the tangential slots 119. In gas operation, therefore, the mixture formation with the combustion air already starts in the zone of the inlet slots 119. It will be understood that in this way a mixed operation with both types of fuel is also possible.

At the burner outlet 118 of the burner 110, as homogeneous a fuel concentration as possible occurs over the annular cross-section to which the fuel is admitted. A defined calotte-shaped recirculation zone 122 develops at the burner outlet, at the tip of which recirculation zone 122 the ignition is effected. The flame itself is stabilized by the recirculation zone in front of the burner without requiring a mechanical flame retention baffle.

According to the invention, the secondary burner 150 is now to be a premixing burner which does not operate by itself. By this it is meant that permanent ignition must be present for the mixture combustion of the secondary burner. This permanent ignition takes place in the present case via the flame at the outlet of the precombustion chamber.

In order to avoid the flame-stabilizing zone at the double-cone burner 150 used, its tangential gaps 159 are widened compared with the gap width at the primary burners 110. Due to this special form of the burner 150, a fuel/air mixture having a peripheral velocity which is not sufficient to form the abovementioned recirculation zone at the burner outlet forms in the premixing space of the burner 150. The mixture leaves the cone with a vortex motion and enters the flame from the precombustion chamber. In the process, intimate mixing is obtained over the shortest distance by the collision of the two vortex flows.

The tangential gaps 119, 159 in the burners are dimensioned in such a way that, for example, about 25% of the total volumetric flow consisting of combustion air and fuel is admitted to the primary burners and about 75% of said volumetric flow is admitted to the secondary burners.

Such a combustion chamber may be operated as follows: to start up the combustion chamber, only the primary burners 110 are operated and are kept in operation over the entire load range. From about 10% load up to full load, fuel is successively admitted to the secondary burners 150.

Concerning the mode of operation:

FIG. 5 shows in a self-explanatory diagram how the temperatures develop along the extent of the combustion chamber. The first row of turbine guide blades is designated therein by 64.

The following zones plotted above the diagram and likewise designated in FIG. 1 mean:

PM Premixing region in the primary burner 110

PC Precombustion

M Mixing zone

BO Burn-out zone in the main combustion chamber 62

ZT Transition zone at the turbine inlet 64

Furthermore:

SMF Second premixing region and fuel injection in the secondary burner 150

EI Location of external ignition at the primary burner

SI Location of self-ignition in the mixing zone M

The following temperatures are plotted on the abscissa:

$T_F$ Flame temperature $T_T$ Turbine inlet temperature $T_{SI}$ self-ignition temperature $T_{IN}$ Temperature of the fuel/air mixture Furthermore:

$dT_{1C}$ Temperature increase as a result of combustion $dT_{1m}$ Temperature drop as a result of mixing $dT_{2m}$ Temperature increase as a result of mixing $dT_{2C}$ Temperature increase as a result of combustion The action of the novel measure is as follows: during the precombustion, nitrogen, as a result of the distribution of the total volumetric flow over primary burner and secondary burner, is only produced at a portion of the volumetric flow on account of the temperature increase dT1C. This partial flow only has a short dwell time in the precombustion chamber 61 until mixing with the mixture from the secondary burners, which has a favorable effect on the NOx production.

During the mixing of the hot flue gases from the precombustion chamber 61 with the fuel/air mixture from the secondary burners, the mixing temperature must not drop below the self-ignition temperature TSI.

After the self-ignition from the primary burner, the temperature increase dT2C of the total volumetric flow is too small and the period up to complete burn-out in the zone BO is too short in order to produce NOx to a substantial degree.

From all this it can be recognized that, in the case of this lean/lean concept, the average volumetric flow is exposed to the high flame temperature only for a reduced time compared with conventional single-stage premixing combustion.

Figure 4:
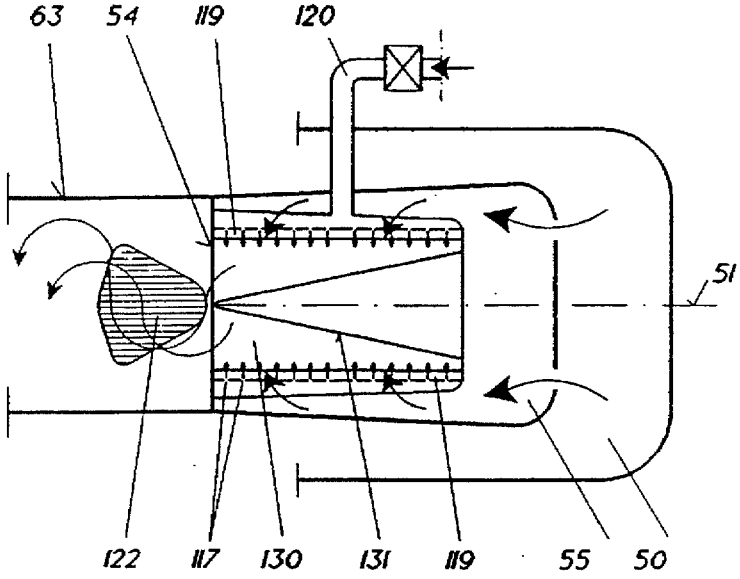
FIG. 4 shows a partial longitudinal section of a combustion chamber variant.

The invention is in principle not restricted to the use of premixing burners of the double-cone type of construction shown. On the contrary, it may be used in all combustion chamber zones in which flame stabilization is produced by a prevailing air velocity field. As a further example of this, reference is made to the burner shown in FIG. 4. In this FIG. 4, all functionally identical elements are provided with the same reference numerals as in the burner according to FIGS. 1–3B. This despite a different structure, which applies in particular to the tangential inflow gaps 119 running cylindrically here. The area of the premixing space 130 through which flow occurs, which air increases in the direction of the burner outlet, is formed in this burner by a centrally arranged insert 131 in the form of a right circular cone, the cone tip being located in the region of the plane of the front plate. It will be understood that the generated surface of the cone may also be curved. This also applies to the progression of the sectional surfaces 111, 112 in the burners shown in FIGS. 1–3B.

Of course, in a deviation from the 2-stage combustion shown and described, more than two stages may also be used. The number of combustion stages and the nature of the fuel and air distribution over the plurality of stages is ultimately dependent upon the desired performance of the combustion chamber.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A combustion chamber with two-stage combustion, comprising:

a wall defining a precombustion space and a main combustion space, at least one primary premixing burner mounted at a head of the precombustion space, the at least one primary premixing burner having two hollow bodies defining an interior premixing space, with center axes of the bodies being offset so that adjacent edges of the bodies define longitudinally extending inlet gaps on opposite sides of the interior premixing space for a tangentially directed flow of combustion air into the interior premixing space, means for introducing combustion air through the inlet gaps into the premixing space, fuel nozzles to inject fuel into the premixing space to mix with the combustion air inside the premixing space, wherein a premixture of fuel and air is produced at a burner outlet, means for igniting the premixture at the burner outlet, and at least one secondary premixing burner mounted on the wall downstream of the precombustion space, the at least one secondary burner having a premixing space to produce a secondary fuel and air mixture into the combustion chamber for auto-ignition of the secondary mixture.

2. The combustion chamber as claimed in claim 1, wherein the secondary burner is a double-cone type burner, having two hollow, conical sectional bodies which are nested one another in a direction of flow to define a premixing space and whose respective center axes are mutually offset, wherein adjacent edges of the two sectional bodies form inlet gaps along a longitudinal direction for a tangentially directed flow of combustion air into the premixing space, and having gas-inflow openings mounted in the longitudinal direction in the two sectional bodies to introduce fuel into the inlet gaps.

3. The combustion chamber as claimed in claim 2, wherein the inlet gaps in the primary and secondary burners are dimensioned so that about 25–50% of a total volumetric flow of combustion air and fuel is admitted to the at least one primary burner and about 50–75% of said total volumetric flow is admitted to the at least one secondary burner.

4. The combustion chamber as claimed in claim 1, wherein, the combustion chamber is an annular combustion chamber, and wherein a longitudinal axis of the at least one primary burner is substantially parallel to a longitudinal axis of the combustion chamber, and wherein a longitudinal axis of the at least one secondary burner is substantially perpendicularly to the longitudinal axis of the primary burner.

5. The combustion chamber as claimed in claim 4, wherein the at least one secondary burner is mounted a distance of about one burner diameter on the longitudinal axis of the combustion chamber from an outlet plane of the primary burner.

6. The combustion chamber as claimed in claim 4, wherein an outlet plane of the at least one secondary burner is set back from the combustion-chamber wall.

7. The combustion chamber as claimed in claim 1, wherein the primary premixing burner is a double-cone burner, wherein the hollow bodies are conical sectional bodies which define a conical premixing space, and wherein the fuel nozzles are mounted along the inlet gaps in the longitudinal direction to inject fuel into the gaps.

* * * * *